US009506408B2

(12) United States Patent
Glugla et al.

(10) Patent No.: US 9,506,408 B2
(45) Date of Patent: Nov. 29, 2016

(54) METHOD OF FUEL INJECTION FOR A VARIABLE DISPLACEMENT ENGINE

(71) Applicant: Ford Global Technologies, LLC, Dearborn, MI (US)

(72) Inventors: Chris Paul Glugla, Macomb, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 388 days.

(21) Appl. No.: 14/294,035

(22) Filed: Jun. 2, 2014

(65) Prior Publication Data

US 2015/0345407 A1 Dec. 3, 2015

(51) Int. Cl.

| | |
|---|---|
| ***F02D 17/02*** | (2006.01) |
| ***F02P 5/04*** | (2006.01) |
| ***F02D 41/30*** | (2006.01) |
| ***F02D 41/00*** | (2006.01) |
| ***F02D 41/04*** | (2006.01) |
| *F01L 13/00* | (2006.01) |
| *F02D 41/38* | (2006.01) |

(52) U.S. Cl.

CPC ..... *F02D 17/02* (2013.01); *F02D 41/0087* (2013.01); *F02D 41/047* (2013.01); *F02D 41/3094* (2013.01); *F02P 5/045* (2013.01); *F01L 13/0005* (2013.01); *F01L 2013/001* (2013.01); *F01L 2800/03* (2013.01); *F02D 2041/389* (2013.01)

(58) Field of Classification Search

CPC .. F02D 17/02; F02D 41/0087; F02D 41/047; F02D 41/3094; F02D 2041/389; F02P 5/045; F01L 13/0005; F01L 2013/001; F01L 2800/03

USPC ..... 123/403, 481, 673, 691, 692, 198 F; 701/103, 104

See application file for complete search history.

(56) References Cited

U.S. PATENT DOCUMENTS

| | | | | |
|---|---|---|---|---|
| 5,377,631 | A * | 1/1995 | Schechter | F01L 9/02 123/198 F |
| 5,642,722 | A * | 7/1997 | Schumacher | F02D 41/047 123/480 |
| 5,735,249 | A * | 4/1998 | Parke | F02D 41/18 123/478 |
| 5,762,054 | A * | 6/1998 | Schumacher | F02D 41/047 123/674 |

(Continued)

OTHER PUBLICATIONS

Surnilla, Gopichandra et al., "Method and System for Engine Control," U.S. Appl. No. 13/854,835, filed Apr. 1, 2013, 50 pages.

(Continued)

*Primary Examiner* — Hung Q Nguyen
*Assistant Examiner* — John Bailey
(74) *Attorney, Agent, or Firm* — Julia Voutyras; Alleman Hall McCoy Russell & Tuttle LLP

(57) ABSTRACT

Various systems and methods are described for controlling fuel injection in a variable displacement engine. One method for a deactivatable cylinder comprises, before deactivating the cylinder responsive to operating conditions, disabling a port injector and fueling the cylinder only via the direct injector. The method further comprises, when reactivating the cylinder from deactivation, enabling both the port injector and the direct injector, and injecting a higher amount of fuel via the direct injector while simultaneously injecting a lower amount of fuel via the port injector.

15 Claims, 8 Drawing Sheets

(56) References Cited

U.S. PATENT DOCUMENTS 6,561,145 B1 5/2003 Stockhausen et al.
6,647,947 B2 11/2003 Boyer et al.
7,128,043 B2 * 10/2006 Lewis ..... F01L 1/38 123/198 F
7,213,548 B2 5/2007 Lewis et al.
7,216,640 B2 5/2007 Song et al.
7,278,397 B2 * 10/2007 Kobayashi ..... F02D 41/047 123/299
7,367,180 B2 * 5/2008 Surnilla ..... F02D 41/0082 123/198 F
7,426,918 B2 9/2008 Brehob et al.
7,555,896 B2 * 7/2009 Lewis ..... F01L 9/04 123/198 F
7,559,309 B2 * 7/2009 Winstead ..... F02D 35/0007 123/198 F
7,562,530 B2 * 7/2009 Kolmanovsky ..... F01L 9/04 60/600
7,647,916 B2 1/2010 Leone et al.
7,789,063 B2 * 9/2010 Lewis ..... F01N 11/007 123/299
8,100,107 B2 * 1/2012 Bidner ..... F02D 41/0025 123/299
8,511,281 B2 8/2013 Tripathi et al.
8,567,370 B2 10/2013 Bidner et al.
8,616,181 B2 12/2013 Sahandiesfanjani et al.
9,328,687 B2 * 5/2016 Jankovic ..... F02D 41/30
2002/0179050 A1 * 12/2002 Soliman ..... F02D 41/1401 123/399
2004/0079342 A1 * 4/2004 Kojima ..... F02B 31/06 123/491
2005/0098156 A1 * 5/2005 Ohtani ..... F02D 41/3094 123/431
2005/0193988 A1 * 9/2005 Bidner ..... F01L 13/00 123/481
2005/0197759 A1 * 9/2005 Surnilla ..... F02P 5/1504 701/103
2005/0204726 A1 * 9/2005 Lewis ..... F02D 13/06 60/285
2005/0205027 A1 * 9/2005 Lewis ..... F01L 9/04 123/90.11
2005/0205049 A1 * 9/2005 Lewis ..... F01L 13/0005 123/198 DB
2005/0205063 A1 * 9/2005 Kolmanovsky ..... F01L 9/04 123/436
2005/0205069 A1 * 9/2005 Lewis ..... F01L 1/38 123/491
2005/0205074 A1 * 9/2005 Gibson ..... F02D 13/0207 123/673
2005/0209045 A1 * 9/2005 Lewis ..... F02D 13/0203 477/107
2006/0231061 A1 * 10/2006 Lewis ..... F02D 13/0215 123/198 F
2006/0241847 A1 * 10/2006 Kolmanovsky ..... F01L 9/04 701/103
2007/0234984 A1 * 10/2007 Kolmanovsky ..... F01L 9/04 123/90.15
2007/0235005 A1 * 10/2007 Lewis ..... F01L 9/04 123/322
2009/0013668 A1 * 1/2009 Winstead ..... F02M 26/43 60/278
2009/0320790 A1 * 12/2009 Lewis ..... F01N 11/002 123/299
2011/0137539 A1 * 6/2011 Jankovic ..... F02D 41/0025 701/103
2011/0162620 A1 * 7/2011 Bidner ..... F02D 41/0025 123/299
2011/0295483 A1 * 12/2011 Ma ..... F02D 41/0002 701/102
2012/0240556 A1 * 9/2012 Lewis ..... F02D 13/06 60/274
2013/0261935 A1 * 10/2013 Jankovic ..... F02D 41/047 701/104
2014/0053803 A1 * 2/2014 Rayl ..... F02D 41/0087 123/350
2014/0278005 A1 * 9/2014 Gibson ..... F02D 41/30 701/104
2014/0278007 A1 * 9/2014 Wilcutts ..... F02D 41/0087 701/104
2014/0360477 A1 * 12/2014 Doering ..... F02D 41/144 123/673
2015/0142296 A1 * 5/2015 Tobergte ..... F02D 13/06 701/103

OTHER PUBLICATIONS

Glugla, Chris P. et al., "Variable Displacement Engine Control System and Method," U.S. Appl. No. 13/968,240, filed Aug. 15, 2013, 65 pages.
Glugla, Chris P. et al., "Variable Displacement Engine Control System and Method," U.S. Appl. No. 13/968,252, filed Aug. 15, 2013, 67 pages.
Glugla, Chris P. et al., "Variable Displacement Engine Control System and Method," U.S. Appl. No. 13/896,059, filed May 16, 2013, 36 pages.
Surnilla, Gopichandra et al., "Method and System for Improved Dilution Tolerance," U.S. Appl. No. 14/075,986, filed Nov. 8, 2013, 54 pages.

* cited by examiner

METHOD OF FUEL INJECTION FOR A VARIABLE DISPLACEMENT ENGINE

TECHNICAL FIELD

The present application relates to controlling fuel injection in a variable displacement engine.

BACKGROUND AND SUMMARY

Engines may be configured to operate with a variable number of active or deactivated cylinders to increase fuel economy, while optionally maintaining the overall exhaust mixture air-fuel ratio about stoichiometry. Such engines are known as variable displacement engines (VDE). In some examples, a portion of an engine's cylinders may be disabled during selected conditions, where the selected conditions can be defined by parameters such as a speed/load window, as well as various other operating conditions including vehicle speed. A VDE control system may disable selected cylinders through the control of a plurality of cylinder valve deactivators that affect the operation of the cylinder's intake and exhaust valves, and/or through the control of a plurality of selectively deactivatable fuel injectors that affect cylinder fueling. By reducing displacement under low torque request situations, the engine is operated at a higher manifold pressure, reducing engine friction due to pumping, and resulting in reduced fuel consumption.

As such, VDE engines configured with only port fuel injection systems may have problems during transitions between VDE and non-VDE modes of operation. For example, transient fuel control may be a concern when reactivating cylinders. Deactivated cylinders may take multiple combustion events, following reactivation, to establish an intake port fuel puddle and attain stable combustion. Further, without an established intake port fuel puddle during the transition, fuelling errors may occur, and emissions and drivability issues may increase due to degraded combustion stability. In another example, during a transition from non-VDE mode to VDE mode of operation, it may be impracticable to trap a fresh air charge in deactivated cylinders because of the time needed for the intake port fuel puddle to dissipate. Specifically, the trapped air charge may include a portion of fuel drawn in from the puddle which may lead to partial burn and/or misfire when the charge is sparked upon reactivation. Alternatively, if the trapped air charge with fuel is expelled without being combusted, unburned hydrocarbons in the exhaust may elevate catalyst temperature leading to degradation of the catalyst.

The inventors herein have recognized the above issues and identified an approach to at least partly address the above issues. In one example approach, a method is provided for an engine with at least one deactivatable cylinder. The method comprises decreasing an amount of fuel injected by a port injector while increasing an amount of fuel injected by a direct injector prior to deactivating the cylinder. In this way, a fuel puddle at an intake port of the cylinder may be completely dissipated before deactivation allowing for trapping a fresh air charge within the deactivated cylinder.

In another example, a method comprises: before selectively deactivating a cylinder in response to operating conditions, reducing a first proportion of fuel injected by a port injector while correspondingly increasing a second proportion of fuel injected by a direct injector, and when reactivating the cylinder from deactivation, increasing the second proportion of fuel delivered via the direct injector relative to the first proportion of fuel delivered via the port injector.

As an example, a variable displacement engine (VDE) system may include selectively deactivatable cylinders, wherein each cylinder is configured with each of a port injector and a direct injector. In response to deactivation conditions, such as reduced engine load or torque demand, one or more cylinders may be deactivated and the engine may be operated in a VDE mode. For example, the engine may be operated with half the cylinders deactivated and with the remaining active cylinders operating at a higher cylinder load. Prior to deactivation and before transitioning from a non-VDE mode to a VDE mode, cylinders selected to be deactivated may be operated with an increased proportion of fuel delivered from their respective direct injectors. Simultaneously, the cylinders may receive a lower proportion of fuel delivered from their respective port injectors. In one example, the port injectors may be disabled and the cylinders may receive substantially no fuel from the port injectors. By reducing the proportion of fuel delivered by the port injectors or disabling the port injectors, existing fuel puddles at the intake ports of the cylinders to be deactivated may thus be consumed. In response to the complete depletion of the fuel puddles, direct injectors may be disabled, fresh air may be drawn into the cylinders and the intake and exhaust valves may be closed and deactivated. In this way, a fresh air charge may be trapped within a deactivated cylinder.

In response to reactivation conditions, such as increased engine load or torque demand, the deactivated cylinders may be reactivated and the engine may resume a non-VDE mode of operation wherein all the cylinders are operated at a lower average cylinder load. Herein, the reactivated cylinders may be operated with an increased proportion of fuel from their respective direct injectors and a reduced proportion of fuel from their respective port injectors until fuel puddles are established in their respective intake ports. The quantity of each intake port fuel puddle may be estimated and when a steady state quantity of fuel is reached within an intake port fuel puddle, the respective cylinder may then receive a smaller proportion of fuel from its direct injector and a larger proportion of fuel from its port injector.

In this way, by fueling a reactivated cylinder with an initial higher ratio of direct injection relative to port injection, transient fuel control may be improved allowing for more stable combustion. At the same time, an intake port fuel puddle may be established via the initial, smaller proportion of port injection allowing for a smoother transition to a higher proportion of port fuel injection at a later time with reduced transient fueling errors. Further, by reducing the proportion of port injected fuel prior to deactivation, a fresh air charge with reduced traces of unburned fuel may be trapped within a deactivated cylinder. Further still, this fresh air charge may be expelled in a un-combusted state from the reactivated cylinder without a concern for elevated temperature at the exhaust catalyst (e.g., due to unburned hydrocarbons in the exhaust) and catalyst performance may be enhanced, while stoichiometry can be retained overall by correspondingly running a non-deactivated cylinder rich while expelling the fresh charge. Stoichiometry can be achieved more accurately because the fresh air quantity has a reduced uncertainty in terms of un-burned or partially burned fuel from the puddle. Overall, by controlling fuel injection ratios during engine operation transitions, engine performance and emissions may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
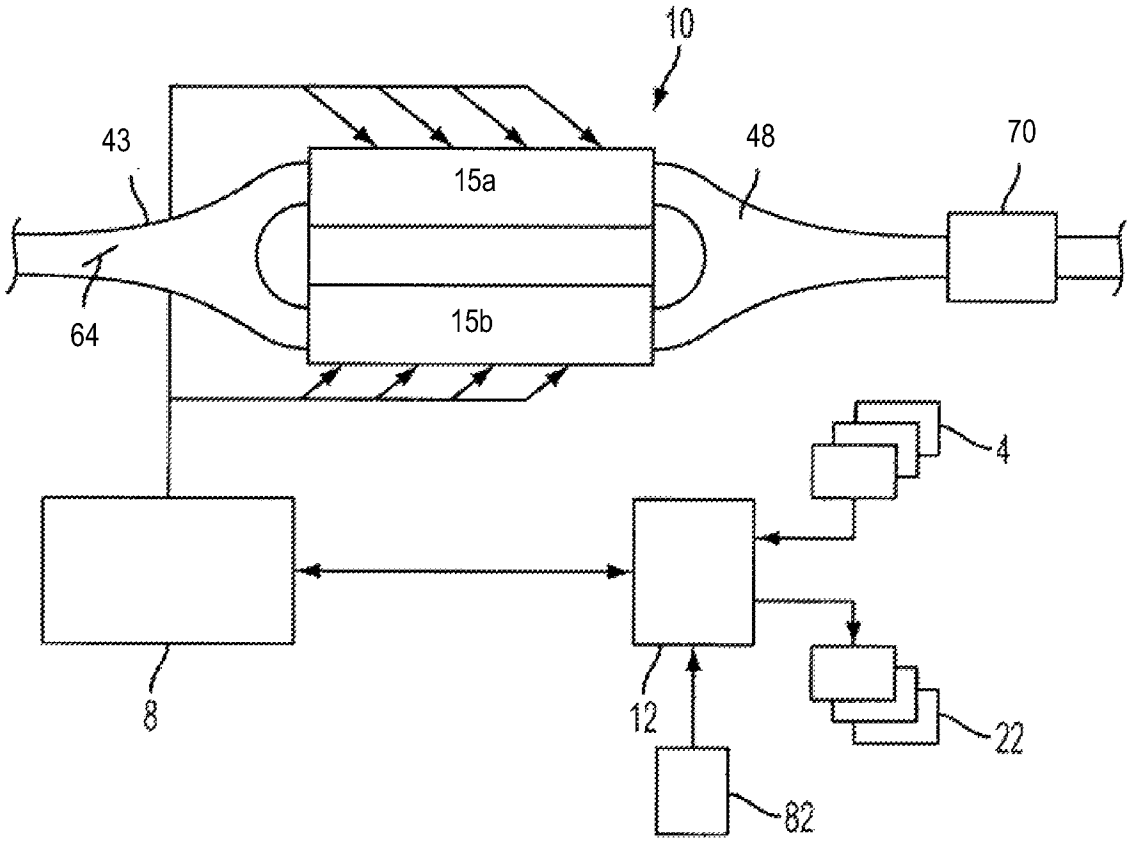
FIG. 1 shows an example layout of a variable displacement engine (VDE) system.
Figure 2:
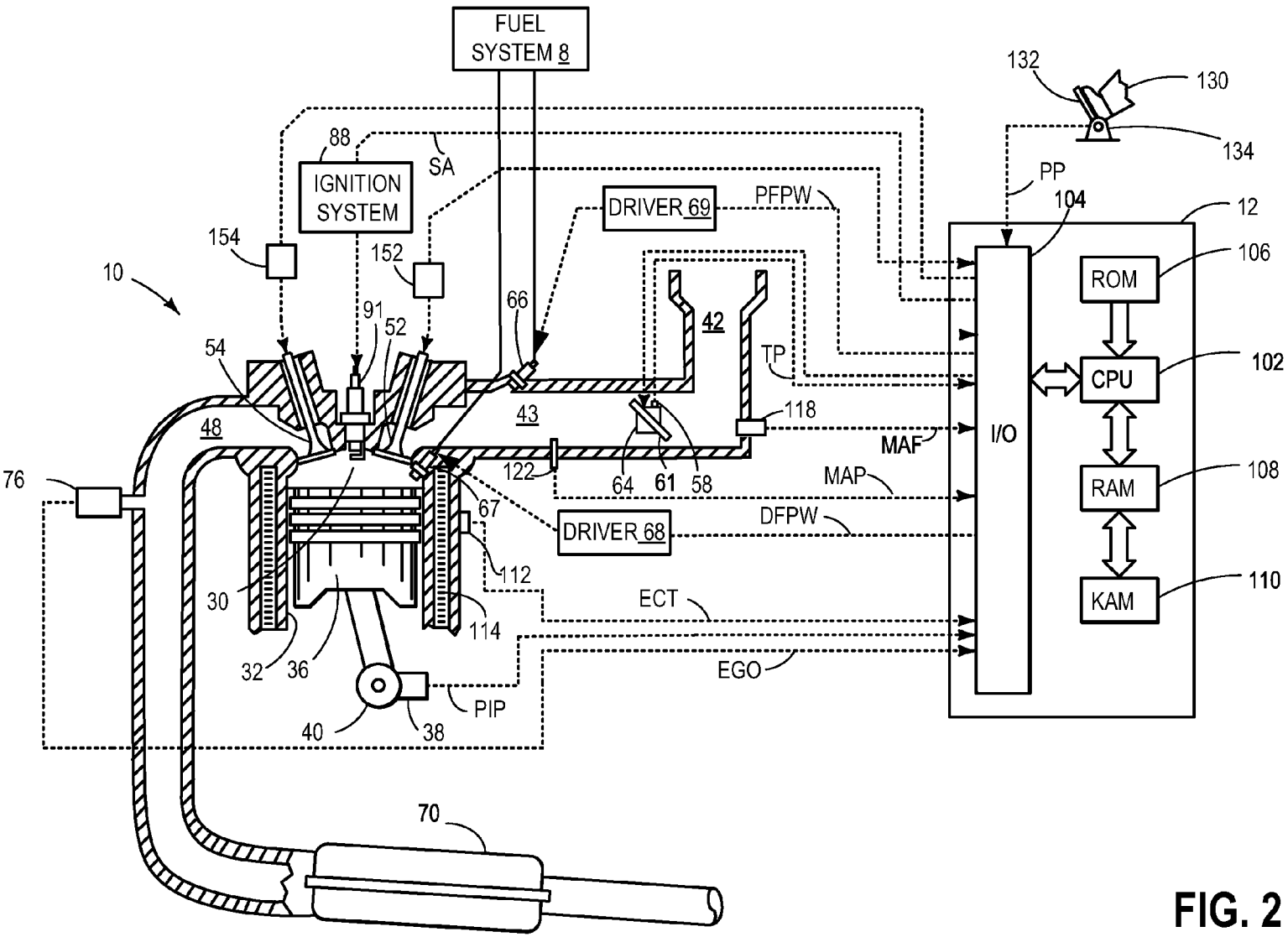
FIG. 2 depicts a partial engine view.
Figure 3:
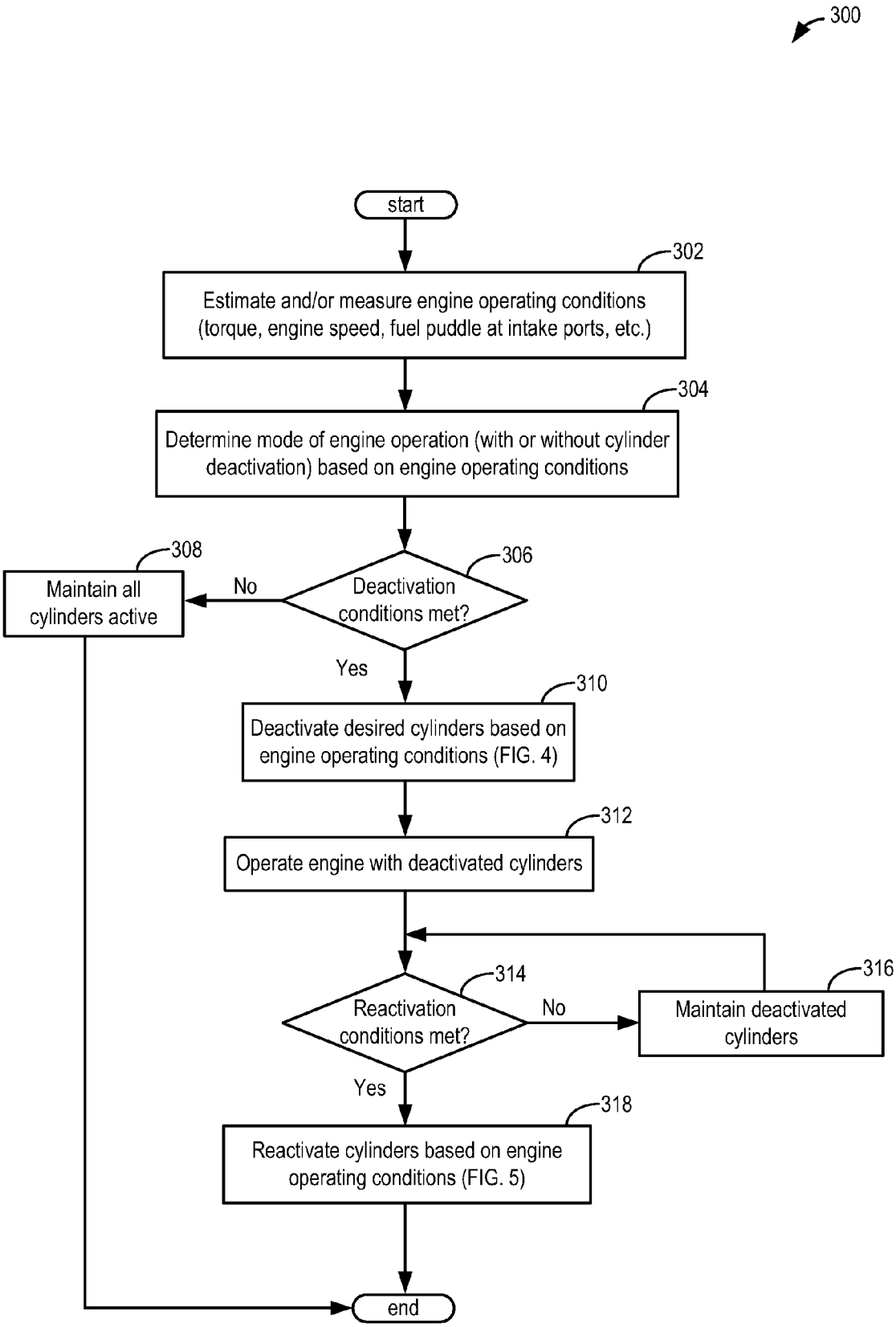
FIG. 3 is a high level flow chart for transitioning cylinders between a deactivated state and a reactivated state based on engine operating conditions.
Figure 4A:
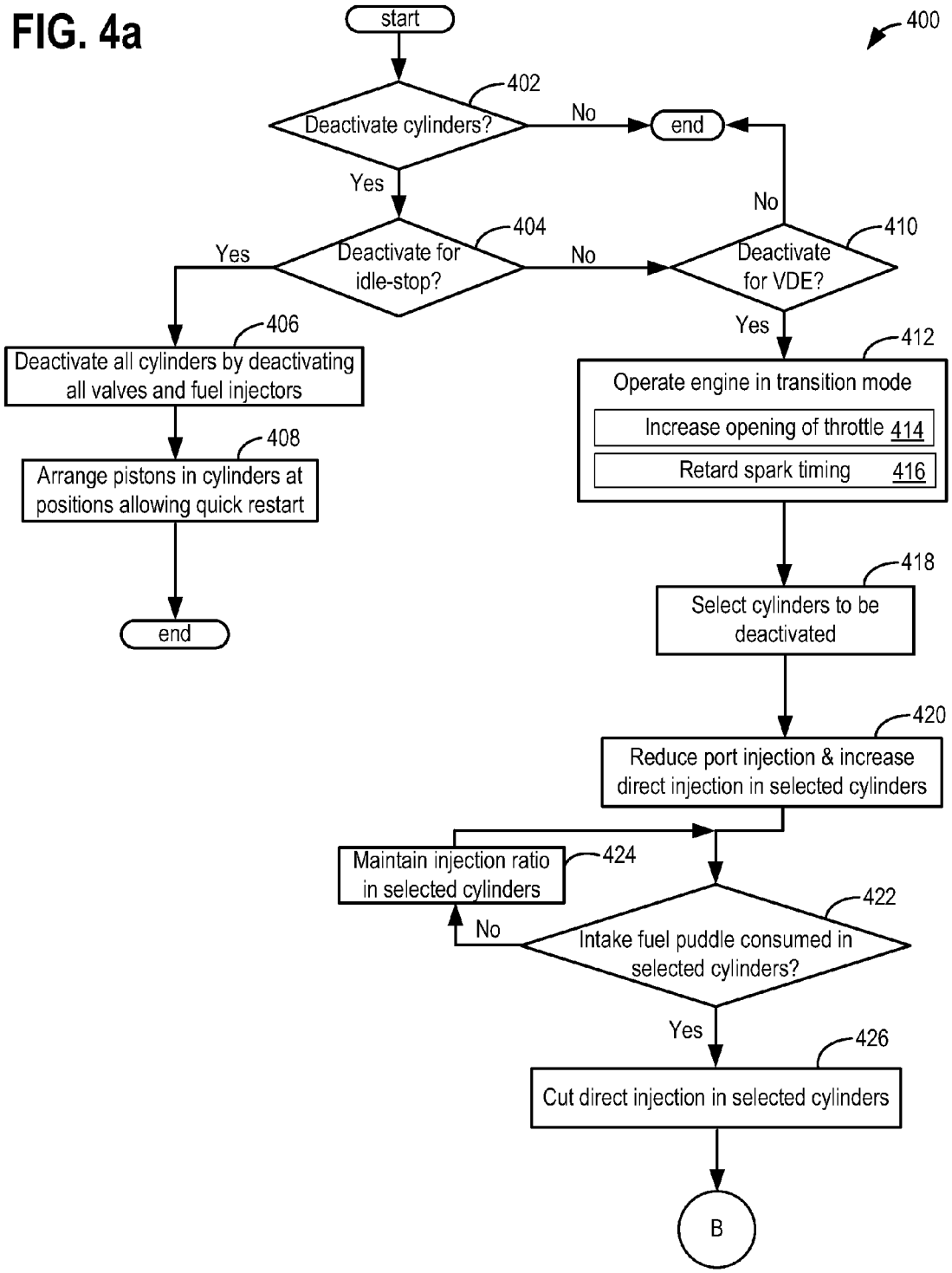
FIGS. 4*a-b* show a flowchart depicting an example method for deactivating selected cylinders, according to the present disclosure.
Figure 4B:
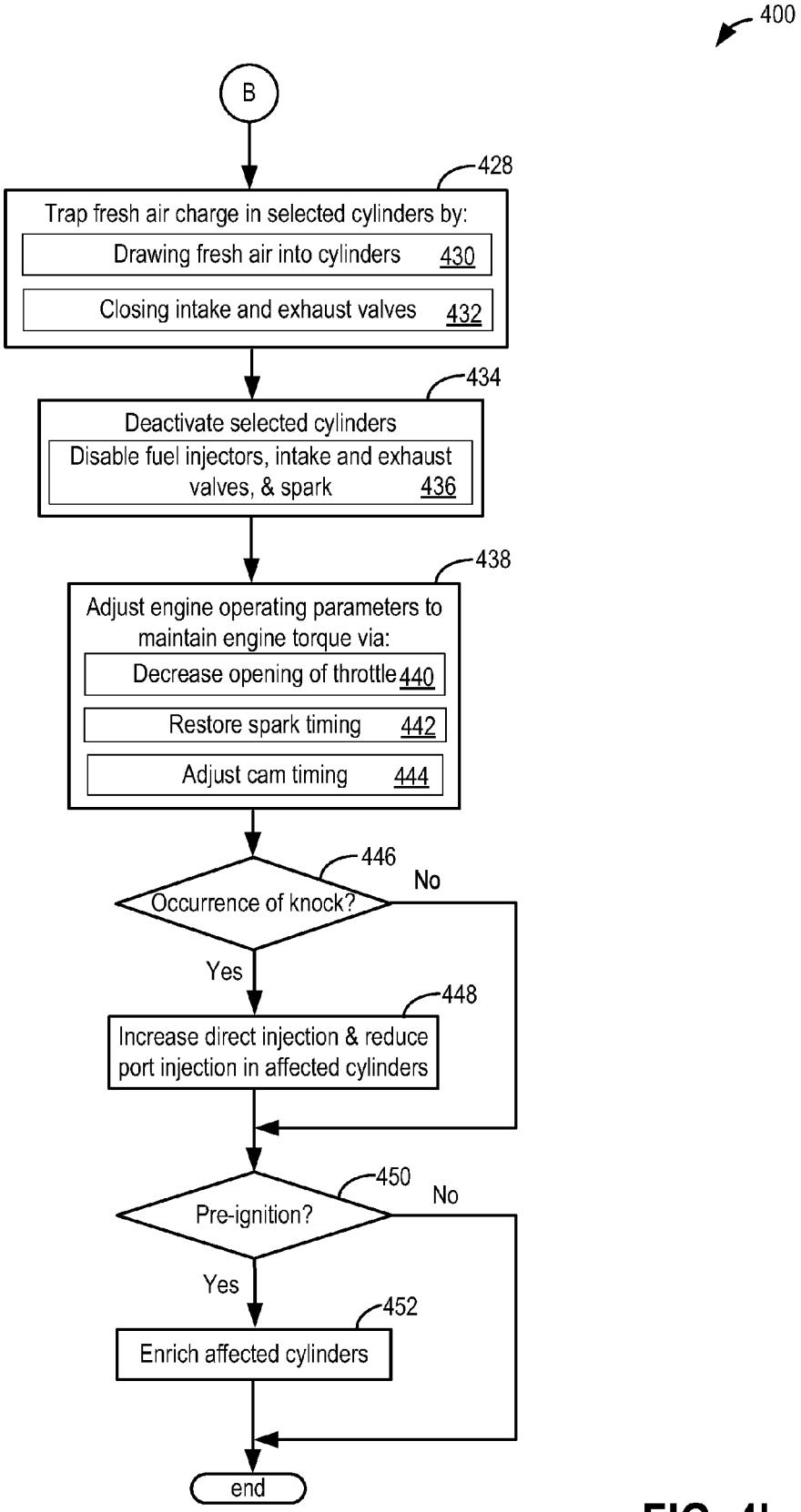
Figure 5:
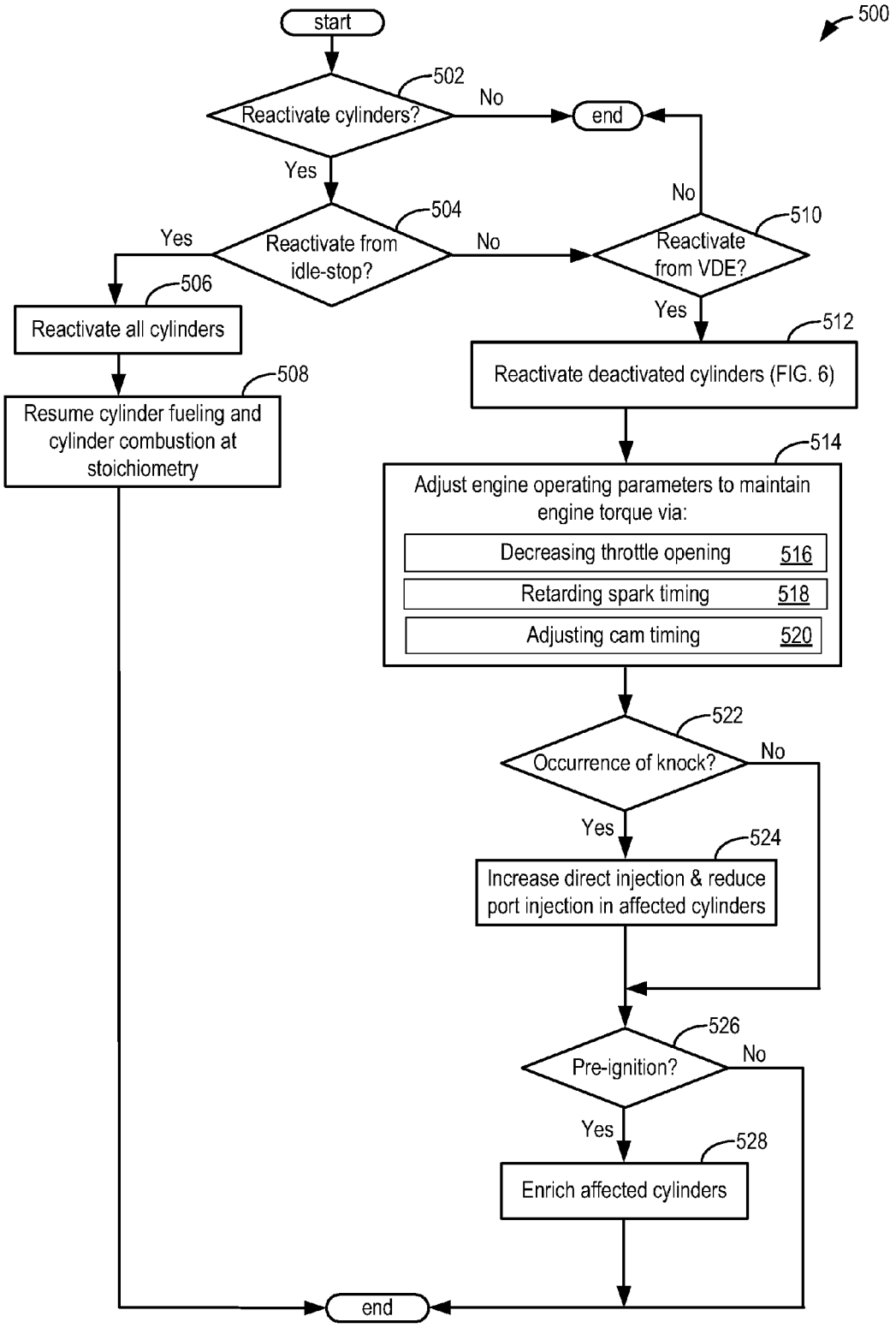
FIG. 5 is a flowchart illustrating an example method for reactivating a deactivated cylinder, in accordance with the present disclosure.
Figure 6:
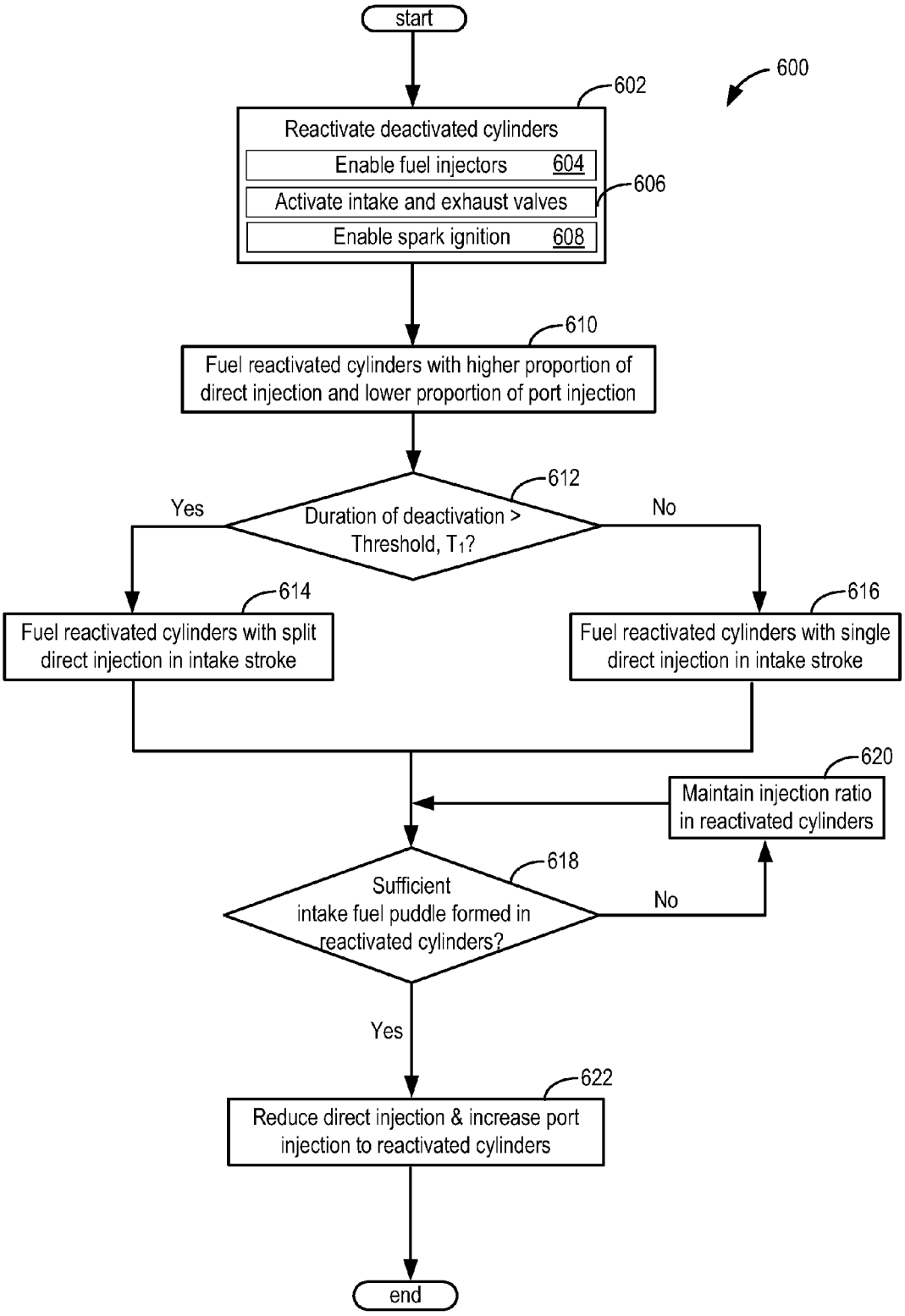
FIG. 6 portrays a flowchart for adjusting fuel injection ratio in a cylinder reactivated from VDE mode.

Methods and systems are described for adjusting fuel injection profiles in selectively deactivatable cylinders of a variable displacement engine (VDE), such as the engine system shown in FIG. 1. Each cylinder in the VDE may be configured with a port injector and a direct injector as shown in FIG. 2. A controller may be configured to transition engine operation from VDE mode to non-VDE mode, or vice versa, based on operating conditions (FIG. 3). A fuel injection profile in a cylinder selected for deactivation may be adjusted such that an intake port fuel puddle is consumed before the cylinder is deactivated and a fresh air charge is trapped (FIG. 4). Additionally, the fuel injection profile may be adjusted in a reactivated cylinder to allow an accumulation of the intake port fuel puddle before port injection is ramped up (FIGS. 5-6). Various operating parameters may be adjusted (FIG. 7), as fuel injection profiles are modified based on cylinder deactivation and reactivation, to reduce torque disturbances during engine mode transitions.

FIG. 1 shows an example variable displacement engine (VDE) 10 having a first bank 15*a* and a second bank 15*b*. In the depicted example, engine 10 is a V8 engine with the first and second banks each having four cylinders. However, in alternate embodiments, the engine may have a different number of engine cylinders, such as 6, 10, 12, etc. Engine 10 has an intake manifold 43, with throttle 64, and an exhaust manifold 48 coupled to an emission control device 70. Emission control device 70 includes one or more catalysts and air-fuel ratio sensors. As one non-limiting example, engine 10 can be included as part of a propulsion system for a passenger vehicle.

During selected conditions, such as when the full torque capability of the engine is not needed, one of a first or a second cylinder group may be selected for deactivation (herein also referred to as a VDE mode of operation). Specifically, one or more cylinders of the selected group of cylinders may be deactivated by shutting off respective fuel injectors, and deactivating the intake and exhaust valves. While fuel injectors of the disabled cylinders are turned off, the remaining enabled cylinders continue to carry out combustion with fuel injectors active and operating. To meet the torque requirements, the engine produces the same amount of torque on those cylinders for which the injectors remain enabled. This requires higher manifold pressures, resulting in lowered pumping losses and increased engine efficiency. Also, the lower effective surface area (from only the enabled cylinders) exposed to combustion reduces engine heat losses, improving the thermal efficiency of the engine.

Cylinders may be grouped for deactivation in a bank-specific manner. For example, in FIG. 1, the first group of cylinders may include the four cylinders of the first bank 15*a* while the second group of cylinders may include the four cylinders of the second bank 15*b*. In an alternate example, instead of one or more cylinders from each bank being deactivated together, two cylinders from each bank of the V8 engine may be selectively deactivated together.

Engine 10 may operate on a plurality of substances, which may be delivered via fuel system 8. Engine 10 may be controlled at least partially by a control system including controller 12. Controller 12 may receive various signals from sensors 4 coupled to engine 10, and send control signals to various actuators 22 coupled to the engine and/or vehicle.

Fuel system 8 may be further coupled to a fuel vapor recovery system (not shown) including one or more canisters for storing refueling and diurnal fuel vapors. During selected conditions, one or more valves of the fuel vapor recovery system may be adjusted to purge the stored fuel vapors to the engine intake manifold to improve fuel economy and reduce exhaust emissions. In one example, the purge vapors may be directed near the intake valve of specific cylinders. For example, during a VDE mode of operation, purge vapors may be directed only to the cylinders that are firing. This may be achieved in engines configured with distinct intake manifolds for distinct groups of cylinders. Alternatively, one or more vapor management valves may be controlled to determine which cylinder gets the purge vapors.

Controller 12 may receive an indication of cylinder knock or pre-ignition from one or more knock sensors 82 distributed along the engine block. When included, the plurality of knock sensors may be distributed symmetrically or asymmetrically along the engine block. As such, the one or more knock sensors 82 may be accelerometers, or ionization sensors. Further details of the engine 10 and an example cylinder are described with regard to FIG. 2.

FIG. 2 depicts an example embodiment of a combustion chamber or cylinder of a spark ignition internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP.

Combustion chamber 30 (also known as, cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 43 via intake passage 42 and may exhaust combustion gases via exhaust manifold 48. A throttle 64 which adjusts a position of throttle plate 61 may be located along intake passage 42 of the engine for varying the flow rate and/or pressure of intake air provided to the engine cylinders Intake manifold 43 and exhaust manifold 48 can selectively communicate with combustion chamber 30 via respective intake valve 52 and exhaust valve 54. In some embodiments, combustion chamber 30 may include two or more intake valves and/or two or more exhaust valves.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

As shown in FIG. 2, cylinder 30 includes two fuel injectors, 66 and 67. Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 (hereafter referred to as "port injector") delivers injected fuel in proportion to the pulse width of signal PFPW received from controller 12 via electronic driver 69.

Fuel injector 67 is shown directly coupled to combustion chamber 30 for delivering injected fuel directly therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 2 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing. Fuel may be delivered to fuel injectors 66 and 67 by a high pressure fuel system 8 including a fuel tank, fuel pumps, and fuel rails (not shown). Hereafter, direct fuel injector 67 will be referred to as "direct injector".

Fuel injectors 66 and 67 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 66 and 67, different effects may be achieved.

Fuel may be delivered by both injectors to the cylinder during a single cycle of the cylinder. For example, each injector may deliver a portion of a total fuel injection that is combusted in cylinder 30. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst, NOx trap, various other emission control devices, or combinations thereof.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 66 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

Controller 12 can control the amount of fuel delivered by fuel injectors 66 and 67 so that the homogeneous, stratified, or combined homogenous/stratified air/fuel mixture in chamber 30 can be selected to be at stoichiometry, a value rich of stoichiometry, or a value lean of stoichiometry.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 58 and an absolute Manifold Pressure Signal MAP from sensor 122. Sensor 122 may be a TMAP (temperature manifold absolute pressure) sensor for measuring each of a temperature and pressure of the air charge mixture received from intake throttle 64. In other embodiments, a distinct temperature sensor may be used to measure intake manifold temperature. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft.

As described above, FIG. 2 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

Storage medium read-only memory 106 can be programmed with computer readable data representing instructions executable by processor 102 for performing the methods described below as well as other variants that are anticipated but not specifically listed. Example methods are discussed with reference to FIGS. 3-6.

Turning to FIG. 3, an example routine 300 is shown that a controller may perform to determine a mode of engine operation based on existing engine conditions. Specifically, routine 300 may determine if conditions are met to allow deactivation of cylinders and if these conditions are met, selected cylinders may be deactivated. Further, based on engine conditions, e.g. torque demand, deactivated cylinders may be reactivated at a later time.

At 302, the routine includes estimating and/or measuring engine operating conditions. These conditions may include, for example, engine speed, desired torque (for example, from a pedal-position sensor), manifold pressure (MAP), manifold air flow (MAF), BP, engine temperature, spark timing, intake manifold temperature, knock limits, etc. The controller may also estimate a quantity of intake port fuel puddle at each cylinder. The quantity of intake port fuel puddle may be estimated based on airflow, amount of fuel injected by a port injector of the given cylinder, and intake manifold temperature.

At 304, based on the estimated operating conditions, routine 300 may determine an engine mode of operation, particularly with or without cylinder deactivation (e.g., VDE or non-VDE). For example, if the torque demand is low, the controller may determine that one or more cylinders can be deactivated while the torque demand is met by the remaining active cylinders. In comparison, if the torque demand is high, the controller may determine that all the cylinders need to remain active. In another example, all cylinders may be deactivated if an engine idle-stop condition is met.

At 306, it may be confirmed if deactivation conditions are met. In one example, cylinder deactivation conditions may be confirmed when torque demand is less than a threshold. If cylinder deactivation conditions are not confirmed, at 308, the routine includes maintaining all the cylinders in an active mode undergoing combustion. On the other hand, if cylinder deactivation conditions are confirmed, at 310, the routine may deactivate cylinders as will be described in further detail in reference to FIG. 4. Further, at 312, the engine may be operated with deactivated cylinders. In one example, the engine may be operated in VDE mode with selected cylinders being deactivated. In another example, if the engine is in an idle-stop mode, the engine may be shut down.

At 314, the routine may determine if reactivation conditions are met. In one example, reactivation conditions may be met when the engine torque demand increases above a threshold. In another example, reactivation conditions may be considered met when the engine has operated in the VDE mode for a specified duration. If reactivation conditions are not met, at 316, the routine continues to maintain deactivated cylinders in their deactivated state. Else, at 318, deactivated cylinders may be reactivated according to routine 500 of FIG. 5. In one example, reactivation may include the engine being operated in a non-VDE mode.

Turning now to FIG. 4, an example routine 400 is shown for deactivating one or more selected cylinders based on engine conditions being met. Specifically, routine 400 modifies a fuel injection profile if the cylinders are being deactivated to achieve a VDE mode of engine operation.

At 402, routine 400 may confirm that cylinders are to be deactivated. If it is not confirmed that cylinders are to be deactivated, routine 400 may end. Else, at 404, the routine may determine if the deactivation is for an engine idle-stop condition. For example, in engines configured with stop/start systems, engine cylinders may be selectively deactivated and the engine may be shut down when idle-stop conditions are met. If it is determined that an engine idle-stop condition exists, at 406, all cylinders may be deactivated. For example, all fuel injectors may be disabled and all valve operation may be deactivated. Further, at 408, pistons within the cylinders may be arranged so as to allow a quick restart of combustion when engine reactivation is commanded. For example, depending on the firing sequence at deactivation, each piston may be at a different position within the cylinder based on the cylinder stroke. By adjusting specific pistons at a certain position, e.g. end of compression stroke, immediate fuel injection and resulting combustion may be achieved when a restart occurs. Routine 400 may then end.

Returning to 404, if the routine determines that cylinder deactivation is not for engine idle-stop condition, at 410, it may be confirmed if the deactivation is for a VDE mode of engine operation. If it is confirmed that the deactivation is not for a VDE mode of engine operation, routine 400 may end.

However, if it is determined that cylinder deactivation is because of an upcoming VDE mode of operation, routine 400 progresses to 412 where the engine may be operated in a transition mode prior to deactivation. In order to compensate for torque disturbances that may arise from cylinder deactivation, various engine parameters may be adjusted. For example, a position of the intake throttle may be adjusted by the controller to regulate an amount of air entering the engine, thereby enabling a desired torque to be provided. Thus, at 414, a throttle opening may be increased to improve air flow into the engine and increase a per-cylinder air charge. Concurrently, at 416, spark timing may be retarded (e.g., by a first amount) to maintain a desired torque on all the cylinders. As such, the engine may now be operated in a pre-VDE transition phase. At 418, cylinders to be deactivated may be selected. Routine 400 may select a group of cylinders and/or an engine bank to deactivate based on the estimated engine operating conditions. The selection may be based on, for example, which group of cylinders was deactivated during a previous VDE mode of operation. For example, if during the previous cylinder deactivation condition, a first group of cylinders on a first engine bank were deactivated, then a controller may select a second group of cylinders on a second engine bank for deactivation during the present VDE mode of operation.

Next, at 420, port injection to the selected cylinders may be reduced and simultaneously, direct injection may be increased. In one example, port injection may be cut and the port injectors may be disabled. Herein, the amount of fuel injected by the port injectors may be substantially zero. By reducing injection of fuel into the intake ports of the selected cylinders, existing intake port fuel puddles may be consumed for combustion during the pre-VDE transition phase. Herein, the selected cylinders may receive a larger proportion of fuel from direct injection and a smaller proportion of fuel from the intake port fuel puddle. At 422, routine 400 may estimate if fuel puddles in the intake ports of the selected cylinders are consumed. The controller may estimate a quantity of an intake port fuel puddle based on one or more of airflow, engine speed, amount of fuel injected by a port injector of a given cylinder, manifold pressure, and manifold temperature. The amount of fuel injected by a port injector may be based upon a pulse width setting of the port injector.

If it is determined that the intake port fuel puddles are not completely consumed, at 424, fueling of the selected cylinders may continue with a larger proportion of fuel from direct injection. On the other hand, if at 422 it is confirmed that the fuel puddles are consumed, at 426, direct injection may be discontinued. If port injection has not been suspended yet, it may be discontinued concurrently. Next, at 428, fresh air may be trapped within the selected cylinders to provide a lower torque impulse during deactivation, with reduced trace fuel (e.g., inducted from the puddle because the puddle has been reduced or been consumed by previously reducing and/or stopping port fuel injection). To achieve trapping of a fresh air charge, at 430, fresh air may first be drawn into the selected cylinders and at 432, respective intake and exhaust valves may be closed, and maintained closed over the duration of deactivation. At 434, selected cylinders may be deactivated by disabling respective fuel injectors, deactivating respective intake and exhaust valves, and disabling spark to the selected cylinders at 436. In this way, a fresh, un-combusted, air charge may be trapped within the cylinder.

The trapped air charge may largely comprise fresh air with insignificant traces of fuel. In other embodiments, combusted gases may be trapped within the deactivated cylinders. Trapping a fresh air charge may have an advantage over trapping combusted gases as the torque bump of compressing a fresh air charge may be less than that of compressing a burnt charge. Further, transitioning between VDE and non-VDE states may be easier by trapping a fresh air charge. Advantages such as increased fuel economy, lower oil consumption within the deactivated cylinder(s) and reduced vibrations may also be attained by trapping a fresh air charge.

Thus, at 434, the engine may be completely transitioned to a VDE mode. Further, at 438, various engine parameters may be adjusted again to maintain torque in VDE mode. At 440, throttle opening may be reduced to decrease airflow once the engine is in VDE mode. The reduction in throttle opening may continue to allow substantial airflow for maintaining torque in VDE mode. Further, airflow may also be reduced to maintain stoichiometry within active cylinders since the engine may be consuming a lower quantity of fuel in VDE mode. Furthermore, at 442, spark timing in active cylinders may be advanced relative to the timing in the transition mode and may be restored to its original timing, e.g., the timing prior to VDE transition mode.

In addition to the above adjustments, valve timings may also be adjusted. For example, at 444, cam timing in the active cylinders may be modified. Camshafts may be positioned to achieve a desired cylinder air charge for delivering a demanded torque. Depending on demanded torque, in one example, exhaust cams may be retarded to allow exhaust residuals within active cylinders. In another example, intake cams may be advanced to enable improved volumetric efficiency in active cylinders.

As such, all the above adjustments may enable a desired airflow to maintain a desired engine torque.

At 446, it may be determined if there is any indication of engine knock. The occurrence of engine knock may be due to an abnormal combustion event occurring in an active cylinder. If knock is not indicated, routine 400 may progress to 450. However, if knock is indicated, at 448, a higher proportion of fuel may be injected via direct injection into the affected cylinder(s) while concurrently decreasing the proportion of port injected fuel. In addition to varying fuel injection ratio, a spark timing adjustment may also be made to alleviate knock.

Next at 450, it may be determined if an indication of pre-ignition is received. If no indication of pre-ignition is received at 450, the routine may end. For example, pre-ignition may not occur at the loads that the active cylinders may be operating at during VDE mode. If, on the other hand, an indication of pre-ignition is received, at 452, the affected cylinders may be enriched and operated at an air fuel ratio that is richer than stoichiometry to mitigate pre-ignition.

Thus, cylinder deactivation may be performed when transitioning from a non-VDE mode to a VDE mode. By decreasing an amount of fuel injected by a port injector while simultaneously increasing an amount of fuel injected by a direct injector prior to deactivating a cylinder, an intake port fuel puddle may be consumed before trapping a fresh air charge. When a quantity of intake port fuel puddle of the cylinder is completely consumed, the operation of the direct injector may be discontinued. Port injection may be simultaneously suspended. Further, a fresh air charge may be trapped within the cylinder by closing and maintaining closed each of an intake valve and an exhaust valve after fresh air is drawn into the cylinder. By ensuring that a fuel puddle in the intake port of the cylinder has been consumed before trapping a fresh air charge, the trapped fresh air charge within the cylinder may be largely free of fuel with less uncertainty as to how much trace fuel may or may not be present and which may or may not burn or partially burn. Therefore, catalyst deactivation may be reduced upon cylinder reactivation when the un-combusted trapped air charge is flushed to the catalyst with few traces of unburned fuel in combination with rich exhaust from other non-deactivated cylinders. Fresh air charge trapping may be followed by cylinder deactivation which may include disabling each of the direct injector and the port injector, deactivating the intake and exhaust valves, and disabling spark ignition within the deactivated cylinder. Thus, during the deactivated phase, the trapped fresh air charge may not be fueled or combusted.

Turning now to FIG. 5, it depicts routine 500 that may be executed by a controller for reactivating a deactivated cylinder (or a group of deactivated cylinders). Specifically, cylinder(s) may be reactivated from a VDE mode or from an idle-stop mode. Further, torque disturbances during transition from a VDE mode to a non-VDE mode of engine operation may be compensated by adjusting various engine parameters.

At 502, it may be confirmed if cylinders are ready to be reactivated. For example, deactivated cylinders may be reactivated when a torque demand increases. If not, routine 500 ends. However, if it is confirmed that cylinder reactivation is desired, routine 500 continues to 504 where it may be determined if the cylinders are being reactivated from an engine idle-stop condition. For example, in engines configured with stop/start systems, engine cylinders may be selectively deactivated and the engine may be shut down when idle-stop conditions are met. The engine may be restarted, and the cylinders reactivated, when restart conditions are met. If the cylinder reactivation at 504 is determined to be responsive to an engine restart from idle-stop, the routine includes reactivating all cylinders at 506. Thus, fuel injectors may be enabled. At 508, cylinder fueling and valve operation may be resumed. In addition, the reactivated cylinders may resume cylinder combustion at or around stoichiometry. In alternate examples, cylinder combustion may be resumed at an alternate air-fuel ratio (e.g., richer or leaner than stoichiometry) based on the engine operating conditions at the restart.

If cylinder reactivation from an idle-stop is not confirmed at 504, at 510 it may be determined if the cylinders are being reactivated from a VDE mode. For example, one or more engine cylinders (e.g., of a selected engine bank) may be selectively deactivated during low torque demand conditions to improve fuel economy. The selected cylinders may be deactivated after trapping a fresh air charge by deactivating fuel and/or valve operation of the cylinders. The cylinders may be reactivated and the engine transitioned to a non-VDE mode when the torque demand increases. If cylinder reactivation from a VDE mode is not confirmed, routine 500 may end.

If cylinder reactivation at 510 is determined to include a transition from VDE mode to non-VDE mode responsive to an increase in torque demand, the routine moves to 512 where the deactivated cylinders may be reactivated. Details regarding the reactivation will be further elaborated below in reference to FIG. 6.

FIG. 6 includes routine 600 for initiating a reactivation of deactivated cylinders from VDE mode. Specifically, reactivated cylinders are fueled with a fuel injection ratio comprising a higher amount of direct injection and a lower amount of port injected fuel. The initial amount of direct injected fuel may be reduced and the initial amount of port injected fuel may be correspondingly increased when an intake port fuel puddle in a reactivated cylinder reaches a steady state value.

At 602, routine 600 includes reactivating the deactivated cylinder(s). As such, one or more previously deactivated cylinders may be reactivated from a VDE mode to a non-VDE mode in response to a higher than threshold torque demand, as elaborated at FIG. 5. The cylinder may be reactivated by reactivating both fuel injectors at 604. As described earlier in reference to FIG. 2, each cylinder of the engine may be configured with a dual fuel injector system including a port injector and a direct injector. Thus, at 604, each of the port injector and the direct injector may be enabled. In some examples, the direct injector may be enabled first and the port injector may be enabled after a certain number of combustion cycles. At 606, valve operation (e.g., by reactivating intake/exhaust valves) may also be resumed and simultaneously, spark ignition may be reactivated at 608. The selected cylinders may be reactivated from a VDE mode where valves of the cylinder are closed, fueling is disabled, but the engine is still spinning as other cylinders continue to undergo combustion.

After the fuel injectors are enabled, at 610, routine 600 may fuel the reactivated cylinders with a higher amount of fuel via the direct injector and a lower amount of fuel via the port injector. In one example where a trapped fresh air charge exists within the cylinder and the charge is compressed, direct injection may provide instant fueling allowing the trapped charge to be combusted. However, it might be difficult to estimate the quantity of trapped air remaining in the cylinder because of trapped air loss due to leakage past the piston rings. Further, oil and other hydrocarbons may partially taint the trapped mixture within the cylinder. Thus, in an alternative example, depending on the exiting piston position within the reactivated cylinder, the trapped fresh air charge may be first expelled from the cylinder before drawing in a separate fresh charge. In this example, since the expelled charge may contain mostly fresh air with minor traces of unburned fuel, the active cylinders may be temporarily enriched to enable stoichiometry of the overall exhaust mixture and improved operation of the exhaust catalyst.

Thus, a group of cylinders may be reactivated, and each of the cylinders may receive a higher proportion of fuel from their respective direct injectors with a lower proportion of fuel from their respective port injectors. The larger proportion of direct injected fuel may be consumed for combustion within the reactivated cylinders while the port injected fuel may be mostly used for generating fuel puddles at their respective intake ports.

Fuel injection via port injectors may occur at non-conventional times and for longer durations to establish an intake port fuel puddle quickly. In one example, fuel may be injected via port injectors in reactivated cylinders during the compression stroke when the intake valve is closed. In another example, the pulse width of port injectors in reactivated cylinders may be extended to deliver sufficient fuel for establishing the intake port fuel puddle. Herein, the fuel puddle may collect on the back of the intake valves and fuel injection may be adjusted to address the collection of fuel at the intake valves.

In yet another example, reactivation may be initiated using only direct injection while the port injectors may remain disabled initially for a certain number of cycles. For example, if a vehicle is accelerating on a highway, a higher torque may be demanded and reactivated cylinders may be fueled with direct injection alone to provide a higher power output. Direct injection may reduce cylinder operation at knock limited torque and provide a higher torque output. However, if the reactivated cylinder is cool, cylinder operation may not be as borderline limited after initial start and therefore, a combination of direct injection and port injection may be used.

Next, at 612, it may be determined if the duration of cylinder deactivation exceeds a Threshold, $T_1$. Based on the duration of time that a cylinder (or a group of cylinders) has been deactivated without combustion, the temperature within the deactivated cylinder(s) may cool substantially. If the cylinder cools significantly, fuel injected by direct injector(s) during an intake stroke may impinge on cooled cylinder walls leading to an increase in smoke and generation of particulate matter. Thus, if it is determined that the deactivated cylinders have been inactive for a duration longer than Threshold, $T_1$, at 614, routine 600 may fuel reactivated cylinders with split direct injections along with port injection. For example, the quantity of fuel delivered via direct injection in a given cylinder may be split into two portions delivered at separate injections within the same intake stroke. In another example, direct injected fuel may be delivered via three injections during a given intake stroke. Multiple direct injections during a given intake stroke may reduce penetration of fuel, and consequently, direct impingement of fuel on cylinder walls. Accordingly, smoke and particulate matter generation may be reduced.

If it is determined that the duration of cylinder deactivation was less than Threshold $T_1$, at 616, the reactivated cylinders may be fueled with a single injection of fuel from direct injectors along with port injection at a smaller proportion.

In another example, instead of using duration of deactivation time, the controller may infer in-cylinder temperature to determine whether the proportion of direct injected fuel may be delivered via split injection or via single injection. Cylinder temperature may be inferred based on number of combustion events in engine since deactivation, coolant temperature, etc.

At 618, routine 600 may determine if a sufficient fuel puddle has formed at each of the intake ports of the reactivated cylinders. In one example, a sufficient quantity of intake puddle may be a steady state quantity such that an amount of fuel deposition within the puddle is balanced by an amount of fuel being drawn into the cylinder intake. In another example, a sufficient quantity of fuel puddle may be a quantity that is accumulated after a certain number of combustion events. In yet another example, a sufficient fuel puddle quantity can be set lower than the steady state amount to enable a quicker transition in fueling, such as at lower engine speeds, whereas at higher engine speeds a higher sufficient fuel puddle quantity can be used. Still other modifications may also be used where the quantity setting of the fuel puddle that is sufficient to enable modification of the fueling injection among PFI and DI is adjusted responsive to engine operating conditions. These conditions may include engine speed as indicated, as well as engine load, engine temperature, manifold temperature, manifold pressure, and others. As explained earlier in reference to FIG. 4, the controller may estimate the quantity of fuel puddle at intake ports based on airflow, amount of fuel injected by the respective port injector, intake manifold pressure (MAP), and intake manifold temperature.

If it is determined that a sufficient fuel puddle has not formed at the intake port(s) of the reactivated cylinder(s), routine 600 may continue to 620 where the reactivated cylinder(s) may continue to receive a higher amount of direct injection and a lower amount of port injection. Thus, the fuel injection ratio of 610 may be maintained at 620.

If a sufficient quantity of fuel puddle has formed within the intake port(s) of the reactivated cylinder(s), at 622, direct injection may be reduced to the reactivated cylinders and port injection may be increased. By fueling a reactivated cylinder (or group of reactivated cylinders) with a larger proportion of direct injected fuel and by waiting to increase port injection until a fuel puddle is formed at an intake port of the reactivated cylinder, problems such as fuelling errors, unstable combustion, and increased emissions may be reduced.

It will be appreciated that if cylinders are deactivated without complete consumption of their respective intake port fuel puddles, fewer combustion events may be necessary to build steady state puddles at their respective intake ports following reactivation.

In this way, when reactivating a cylinder from deactivation, a second proportion of fuel delivered via a direct injector may be increased relative to a first proportion of fuel delivered by the port injector. Further, the second proportion of fuel injected by the direct injector may be reduced responsive to a quantity of intake port fuel puddle attaining a steady state value. At the same time, fuel injected by the port injector may be increased.

Returning now to 514 of routine 500, engine operating parameters may be modified to maintain engine torque output after reactivation of deactivated cylinders. During a transition out of the deactivated state (that is, during reactivation), an opening of the intake throttle may be decreased at 516 to allow the MAP to decrease. Since the number of firing cylinders may have increased in the transition from VDE mode to non-VDE mode, the airflow and thus, MAP to each of the firing cylinders, may need to be decreased to minimize torque disturbances. Therefore, adjustments may be made such that the intake manifold may be filled to a lesser extent with air to achieve an air charge and MAP that will provide the driver-demanded torque as soon as the cylinders are reactivated. Accordingly, based on an estimation of engine operating parameters, the engine's throttle may be adjusted to reduce airflow and the MAP to a desired level. In one example, the intake throttle may be adjusted to a closed position. In another example, the throttle opening may be reduced to allow sufficient airflow to the increased number of active cylinders while maintaining torque. At the same time, at 518, spark timing may be retarded (e.g., by a second, different amount) to maintain a constant torque on all the cylinders, thereby reducing cylinder torque disturbances.

When sufficient MAP is reestablished, spark timing may be restored. In addition to throttle and spark timing adjustments, valve timing may be adjusted at 520 to compensate for torque disturbances. Cam timings may be modified to deliver desired air charges to the cylinder(s) to provide demanded torque. In one example, if cylinder air charge is lighter, exhaust cam timing may be advanced to reduce residuals and ensure complete combustion. In another example, if a higher torque is demanded, intake cams may be fully advanced and exhaust cams may be retarded to provide lower dilution and increased power.

At 522, routine 500 may confirm if knock is indicated. Knocking may occur due to unstable combustion in reactivated cylinders. If knocking is not indicated, routine 500 may progress to 526. For example, at moderate loads, cylinders that were deactivated may be cooler, and therefore, knock may not occur at start. If knock is indicated, at 524, direct injection into the affected cylinders may be increased while simultaneously decreasing port injection. For example, if a reactivated cylinder is affected by knock, its initial fuel injection ratio of 20% port injection:80% direct injection may be changed to a second ratio of 10% port injection:90% direct injection. In another example, port injection may be discontinued and the affected cylinder may be entirely fueled via direct injection, e.g. a ratio of 0% port injection:100% direct injection.

Next at 526, it may be determined if there is any indication of pre-ignition. If not, routine 500 ends. If pre-ignition is indicated, at 528, the affected cylinders may be enriched and may be operated at a richer than stoichiometric air fuel ratio.

In this way, deactivated cylinders may be reactivated from a VDE mode while compensating for torque disturbances and resolving pre-ignition and/or knock issues. Further, reactivated cylinders may be operated initially with a higher ratio of direct injected fuel relative to port injected fuel. By fueling reactivated cylinders with a larger proportion of direct injected fuel, the air-fuel ratio may be at or about stoichiometric, thereby reducing problems of degraded combustion. In addition, an intake port fuel puddle may be generated by simultaneously operating the port injector. By waiting to establish an intake port fuel puddle before transitioning to a higher proportion of port injection, better fuel control may be achieved.

Figure 7:
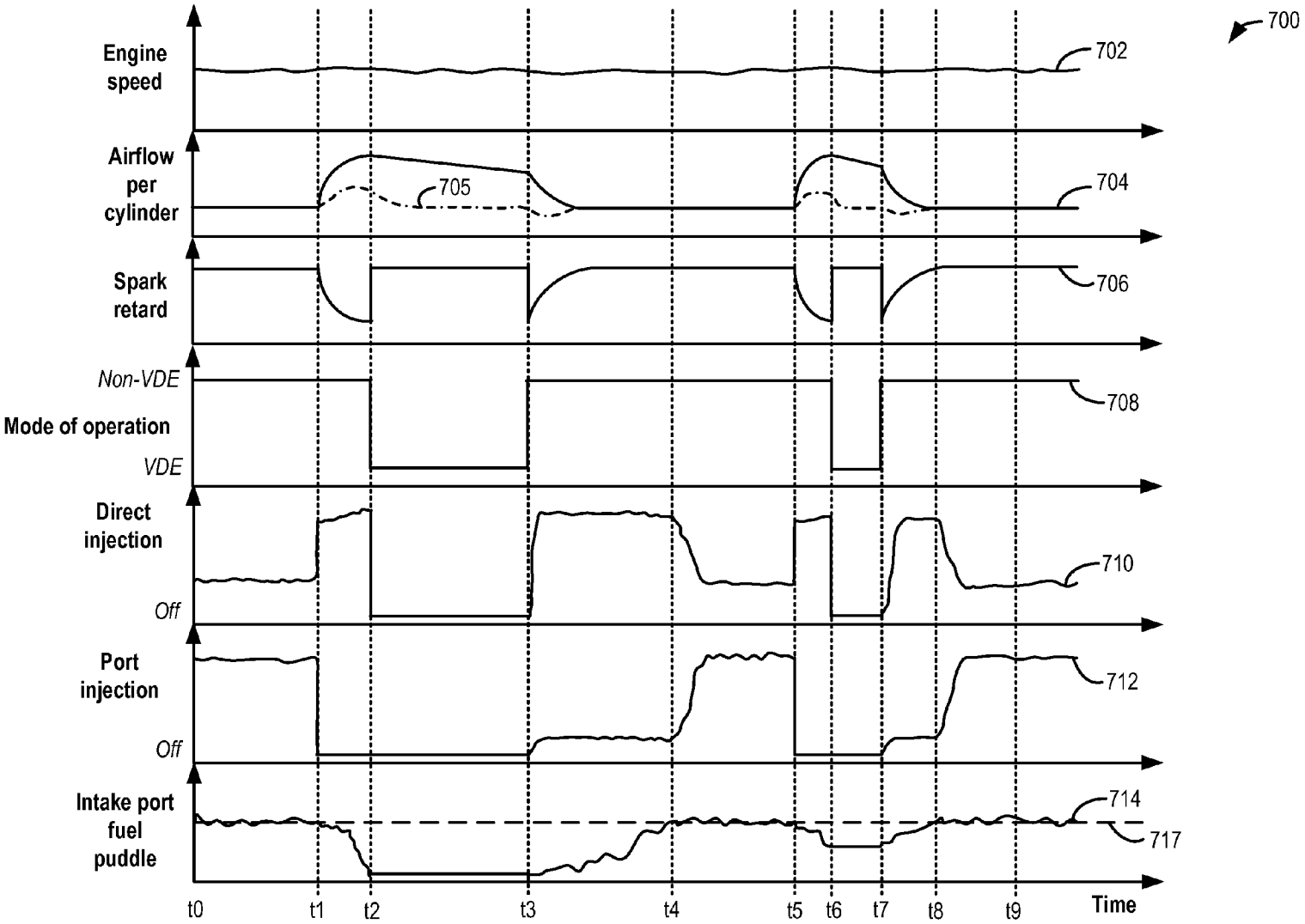
FIG. 7 is an example adjustment of fuel injection ratios during cylinder deactivation and reactivation conditions with concurrent adjustments to engine operating parameters.

Turning now to FIG. 7, it illustrates map 700 depicting example transitions from non-VDE mode to VDE mode, and includes examples of adjustments to fuel injection ratio and concurrent modifications in engine operating parameters in response to the transitions. Map 700 shows engine speed at plot 702, airflow per cylinder at plot 704, airflow into intake manifold at plot 705, spark retard at plot 706, an engine mode of operation (VDE or non-VDE) at 708, fuel injected via direct injection at plot 710, fuel injected via port injection at plot 712, and a quantity of intake port fuel puddle at plot 714. All the above are plotted against time on the X-axis. Line 717 represents a steady state quantity of intake port fuel puddle. In particular, plot 706 shows spark retard as applied to active cylinders and plot 704 shows airflow per active cylinder. Further, plots 710, 712, and 714 are predominantly for fuel injection and fuel puddle conditions of an engine cylinder chosen for selective deactivation and reactivation.

Prior to t1, based on an operator torque demand, the engine may be operating in a non-VDE mode (plot 708) with all cylinders firing. Further, the cylinders may be fueled with a smaller proportion of direct injected fuel (plot 710) and a larger proportion of port injected fuel (plot 712). A fuel puddle at an intake port of the combusting cylinder may be at a steady state quantity (plot 714) wherein the amount of fuel being added to the puddle may be balanced by an amount being removed from the puddle for combustion.

At t1, a transition to VDE mode may be initiated by a vehicle controller. For example, desired engine torque may be lower and a VDE mode may be able to provide the desired torque while improving engine fuel economy. Thus, one or more engine cylinders (e.g., a first group of cylinders or cylinders of a first engine bank) may be deactivated while the desired torque may be met by the remaining active cylinders (e.g., a second group of cylinders or cylinders of a second engine bank). In response to the transition to VDE mode, at t1, port injection may be discontinued and the amount of fuel delivered by the port injector may be substantially zero. At the same time, the proportion of direct injected fuel may be increased. Further, to ensure that torque disturbances are reduced during the transition from non-VDE mode to VDE mode, an opening of an intake throttle may be increased resulting in an increased airflow to active cylinders between t1 and t2. Airflow into the intake manifold (plot 705) may increase slightly. Simultaneously, to reduce the resulting increase in engine torque, spark may be retarded. Therefore, engine speed during the transition remains relatively constant.

Thus, during a pre-transition phase between t1 and t2, airflow per cylinder may be increased while applying a spark retard. Since port injection has been suspended, the quantity of intake port fuel puddle steadily decreases and at t2, the puddle may be substantially consumed. In response to the fuel puddle being completely consumed, direct injection may be discontinued at t2. Additionally, a fresh air charge may be trapped within the selected cylinder(s) prior to deactivation of the cylinder. As mentioned earlier, cylinder deactivation may include disabling both the direct injector and the port injector, deactivating the intake and exhaust valves and suspending spark ignition in the deactivated cylinders. Thus, the controller may transition engine operation from a non-VDE mode to a VDE mode at t2. Further, at t2, the spark timing may be restored. In one example, spark timing may be adjusted to maximum brake torque (MBT). In another example, spark timing may be advanced relative to the retard applied at t1 but may be retarded relative to MBT. The active cylinders in VDE mode may be fueled primarily via direct injection to allow a smoother transition out of VDE into non-VDE mode.

Between t2 and t3, the engine may be operated in the VDE mode wherein the selectively deactivated cylinder is not fueled. However, active cylinders may be fueled and may be undergoing combustion. Further, the throttle opening may be reduced slightly to decrease airflow per active cylinder to provide stoichiometric operation in active cylinders with reduced fuel consumption.

At t3, engine operation may be transitioned from VDE mode to non-VDE mode. Specifically, the deactivated cylinder(s) may be reactivated by resuming cylinder fueling and valve operation. In response to the transition to non-VDE mode, the intake throttle opening may be decreased to reduce airflow into the intake. Accordingly, airflow per cylinder gradually reduces (plot 704). Airflow into the intake may also decrease but the decrease is relatively smaller. As such, when the deactivated cylinder (or group of cylinders) is reactivated, the desired air charge and thus, the MAP for the reactivated cylinder may decrease (since a larger number of cylinders will now be operating) to maintain a desired engine torque output. At the same time, spark timing in the active cylinders may be retarded to compensate for torque disturbances during the transition. Due to these adjustments, engine speed remains relatively unchanged.

In addition, the cylinder may be fueled with a higher amount of direct injected fuel (plot 710) and a lower amount of port injected fuel (plot 712). In one example, direct injected fuel may be delivered in a single injection during the intake stroke. In another example, if it is determined that the cylinder walls of the reactivated cylinder have cooled off, the portion of direct injected fuel may be delivered via two or more injections during the intake stroke. Between t3 and t4, the quantity of intake port fuel puddle may steadily increase from fuel received via the port injector. In one example, the port injector may deliver fuel during a compression stroke when the intake valve is closed to achieve a faster build-up of the intake port puddle. At t4, the fuel puddle may reach a steady state value (threshold 717) and in response, the proportion of fuel injected by the direct injector may be reduced. Concurrently, the amount of port injected fuel may be increased such that a desired injection ratio is achieved to balance engine power and emissions. Between t4 and t5, the engine may be operated in a non-VDE mode.

At t5, the controller may decide to transition engine operation to VDE mode again, and may select cylinders to be deactivated. Therefore, at t5, port injection may be stopped (plot 712) and direct injection may be increased (plot 710) in the cylinder selected to be deactivated. At the same time, airflow per cylinder may be increased and spark timing may be retarded. In the pre-transition phase between t5 and t6, the quantity of intake port fuel puddle may decrease below its steady state value.

Herein, the controller may deactivate the selected cylinder at t6 in response to a significant drop in torque demand. For example, the vehicle may be cruising on a highway at low loads and the controller may deactivate the selected cylinder(s) before the intake puddle is completely consumed. Thus, at t6, direct injection is discontinued and the trapped air charge within the deactivated cylinder may contain traces of fuel from the intake port fuel puddle. Further, at t6, the selected cylinder(s) may be deactivated by disabling both fuel injectors, deactivating respective intake and exhaust valves, and disabling spark ignition.

At t7, the controller may enable a transition to non-VDE mode engine operation. Therefore, at t7, the airflow per cylinder is decreased and a spark retard may be applied to the active cylinders to reduce torque disturbances. Further, the reactivated cylinder(s) may be fueled with an increased proportion of direct injected fuel relative to that injected by the port injector. Further still, the fuel puddle, not having completely dissipated at t6, may rapidly reach its steady state quantity at t8. Thus, at t8, direct injection may be reduced and port injection may be increased. Herein, the reactivation fuel injection ratio with increased direct injection and reduced port injection is maintained for a shorter duration (between t7 and t8) as compared with that in the first reactivation phase between t3 and t4.

It will be appreciated that in the second deactivation example (between t5 and t6), the trapped air charge may contain a portion of fuel drawn in from the intake port fuel puddle. Further still, this unburned fuel may be expelled to the catalyst upon reactivation and may cause higher temperatures at the exhaust catalyst. In the example when the intake port fuel puddle is completely consumed before the cylinder is deactivated, the trapped air charge in the deactivated cylinder may comprise largely fresh air. Herein, upon reactivation, the fresh air charge may be released to the catalyst while the active cylinders may be temporarily enriched to enable stoichiometry at the catalyst.

Thus, in another representation, a system may comprise an engine including a cylinder capable of deactivation, a port injector and a direct injector coupled to the cylinder, and a controller with computer-readable instructions stored in non-transitory memory for, during a first mode, deactivating the cylinder after a fuel puddle at an intake port of the cylinder is completely consumed, and during a second mode, deactivating the cylinder before the fuel puddle at the intake port of the cylinder is completely consumed.

In this way, selective deactivation and reactivation of cylinders may be performed with improved control on transient fueling issues. By ensuring complete depletion of an intake port fuel puddle before deactivation, a fresh air charge with reduced traces of fuel may be trapped within the deactivated cylinder. Upon reactivation, this fresh, un-combusted air charge may be expelled from the cylinder with a lower amount of unburned hydrocarbons reaching the catalyst. Further still, if the trapped fresh air charge is combusted, it may be fueled with a known quantity of fuel allowing stable combustion. Thus, problems such as partial burns, misfires, and incomplete combustion that may result when combusting trapped charge containing an unknown quantity of fuel from prior to deactivation are avoided. By fueling the reactivated cylinder primarily via direct injection, the port injected fuel may be largely used to establish the previously consumed intake port fuel puddle. Furthermore, by reactivating the cylinder with direct injection, transient fuel control issues associated with using a port injection system alone may be reduced. Overall, emissions and drivability issues related to degraded combustion may be reduced.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine including a selectively deactivatable cylinder, comprising:

decreasing an amount of fuel injected by a port injector while increasing an amount of fuel injected by a direct injector prior to deactivating the cylinder;

wherein the amount of fuel injected by the port injector is substantially zero;

further comprising discontinuing fueling via the direct injector when a quantity of intake port fuel puddle of the cylinder is completely consumed.

2. The method of claim 1, wherein the quantity of intake port fuel puddle of the cylinder is estimated based on one or more of airflow, amount of fuel injected by a port injector of the cylinder, intake manifold pressure, and intake manifold temperature.

3. The method of claim 1, further comprising trapping a fresh air charge before deactivating the cylinder, the trapping achieved by closing and maintaining closed each of an intake valve and an exhaust valve throughout one or more cylinder cycles after fresh air is drawn into the cylinder.

4. The method of claim 3, further comprising deactivating the cylinder by disabling each of the port injector and the direct injector, deactivating the intake valve and the exhaust valve, and disabling spark ignition within the deactivated cylinder.

5. The method of claim 4, further comprising adjusting an engine operating parameter in response to the deactivating of the cylinder to maintain engine torque.

6. The method of claim 5, wherein the engine operating parameter includes an opening of an intake throttle, and wherein the adjusting includes increasing the opening of the intake throttle.

7. The method of claim 5, wherein the engine operating parameter includes spark timing, and wherein the adjusting includes retarding the spark timing.

8. A method for an engine including a cylinder, comprising:

before selectively deactivating the cylinder in response to operating conditions, reducing a first proportion of fuel injected by a port injector while correspondingly increasing a second proportion of fuel injected by a direct injector; and when reactivating the cylinder from deactivation, increasing the second proportion of fuel delivered via the direct injector relative to the first proportion of fuel delivered via the port injector; further comprising estimating a quantity of fuel puddle at an intake port of the cylinder; further comprising, before selectively deactivating the cylinder, discontinuing fueling via the direct injector when the quantity of fuel puddle is completely consumed.

9. The method of claim 8, further comprising, when reactivating a cylinder, decreasing the second proportion of fuel delivered via the direct injector and concurrently increasing the first proportion of fuel delivered by the port injector responsive to the quantity of fuel puddle attaining a steady state value.

10. The method of claim 8, further comprising, when reactivating a cylinder, decreasing the second proportion of fuel delivered via the direct injector and concurrently increasing the first proportion of fuel delivered by the port injector responsive to the quantity of fuel puddle reaching a threshold, the threshold adjusted responsive to operating conditions.

11. The method of claim 8, further comprising, adjusting one or more engine operating parameters responsive to torque disturbances caused by reactivating the cylinder.

12. A system, comprising:

an engine including a cylinder capable of deactivation;

a port injector and a direct injector coupled to the cylinder; and a controller with computer-readable instructions stored in non-transitory memory for:

before deactivating the cylinder responsive to operating conditions: disabling the port injector; and fueling the cylinder only via the direct injector; and when reactivating the cylinder from deactivation:

enabling both the port injector and the direct injector; and injecting a higher amount of fuel via the direct injector while simultaneously injecting a lower amount of fuel via the port injector wherein before deactivating the cylinder responsive to operating conditions, the controller is further configured to discontinue the fueling via the direct injector when a fuel puddle in an intake port of the cylinder is consumed.

13. The system of claim 12, wherein the controller is further configured for estimating a quantity of the fuel puddle in the intake port of the cylinder based on one or more of airflow, amount of fuel injected by the port injector, manifold pressure, and intake manifold temperature.

14. The system of claim 13, wherein when reactivating the cylinder, the controller is further configured for decreasing the amount of fuel from the direct injector as the quantity of the intake port fuel puddle increases, and correspondingly increasing the amount of fuel from the port injector.

15. The system of claim 12, wherein the controller is further configured for, before deactivating the cylinder, trapping a fresh air charge within the cylinder, the fresh air charge not being fueled or combusted during the deactivation.

* * * * *